US009348310B2

(12) United States Patent
Sadamitsu

(10) Patent No.: US 9,348,310 B2
(45) Date of Patent: May 24, 2016

(54) IMAGE FORMING APPARATUS

(71) Applicant: Canon Kabushiki Kaisha, Tokyo (JP)

(72) Inventor: Yushi Sadamitsu, Toride (JP)

(73) Assignee: CANON KABUSHIKI KAISHA, Tokyo (JP)

( * ) Notice: Subject to any disclaimer, the term of this patent is extended or adjusted under 35 U.S.C. 154(b) by 0 days.

(21) Appl. No.: 13/859,068

(22) Filed: Apr. 9, 2013

(65) Prior Publication Data

US 2013/0287426 A1 Oct. 31, 2013

(30) Foreign Application Priority Data

Apr. 26, 2012 (JP) ..... 2012-101233

(51) Int. Cl.
*G03G 21/20* (2006.01)
*G03G 15/08* (2006.01)

(52) U.S. Cl.
CPC ..... *G03G 21/206* (2013.01); *G03G 15/0848* (2013.01)

(58) Field of Classification Search
CPC . G03G 21/206; G03G 15/104; G03G 15/235; G03G 15/6573; G03G 21/20; G03G 2215/00772; G03G 2215/00776; G03G 2215/0141; G03G 2215/017; G03G 2215/0695; G03G 2221/1645; G03G 2221/1815; G03G 15/084
USPC ..... 399/92, 94, 44, 13, 237, 262, 302, 308, 399/364, 381, 397, 401, 69, 97
See application file for complete search history.

(56) References Cited

U.S. PATENT DOCUMENTS

| | | | | |
|---|---|---|---|---|
| 8,401,406 | B2 | 3/2013 | Nose | |
| 2009/0136242 | A1* | 5/2009 | Okamoto et al. | 399/13 |
| 2011/0052220 | A1 | 3/2011 | Nose | |
| 2012/0070174 | A1* | 3/2012 | Matsumoto | 399/69 |
| 2012/0230707 | A1* | 9/2012 | Shigehiro | 399/27 |
| 2012/0230720 | A1* | 9/2012 | Murano | 399/92 |
| 2012/0301159 | A1* | 11/2012 | Takahashi | 399/27 |
| 2013/0335476 | A1* | 12/2013 | Ramesh et al. | 347/17 |

FOREIGN PATENT DOCUMENTS

| | | | |
|---|---|---|---|
| JP | 9-305019 | A | 11/1997 |
| JP | 2002-132121 | A | 5/2002 |
| JP | 2006-58398 | A | 3/2006 |
| JP | 4280370 | B2 | 6/2009 |
| JP | 2009-217067 | A | 9/2009 |
| JP | 2009-229825 | A | 10/2009 |
| JP | 2011-48083 | A | 3/2011 |

* cited by examiner

*Primary Examiner* — Roy Y Yi
(74) *Attorney, Agent, or Firm* — Fitzpatrick, Cella, Harper & Scinto

(57) ABSTRACT

In an image forming apparatus, a first cooling unit sends airflow to cool a first developing unit, and a second cooling unit sends airflow to cool a second developing unit. A control section controls the first and second cooling units in a first mode where image formation is executed using both a first and second image forming section, and in a second mode where image formation is executed such that the first developing unit is suspended but the first image bearing body is driven, using an image forming section. In the first mode the first cooling unit is controlled based on an output of a first temperature sensor regardless of a temperature detected by a second temperature sensor, and in the second mode the first cooling unit is controlled based on an output of the second temperature sensor regardless of a temperature detected by the first temperature sensor.

15 Claims, 5 Drawing Sheets

IMAGE FORMING APPARATUS

BACKGROUND OF THE INVENTION

1. Field of the Invention

The present invention relates to an image forming apparatus using an electrophotographic process, such as a copying machine, a printer, or a facsimile.

2. Description of the Related Art

In a developing unit installed in an electrophotographic image forming apparatus, when the temperature of a developer is raised due to stirring of the developer, the charging characteristics of the developer may be deteriorated to cause an image failure such as reduction in image density. Further, when temperature around a photosensitive body is raised due to friction between the photosensitive body and a photosensitive body cleaner, there is also a problem of causing toner to melt and attach to the photosensitive body. Therefore, the developer is cooled or the discharge of toner is controlled to reduce the deterioration of the developer, and cooling is performed around the photosensitive body to suppress the temperature rise of the photosensitive body.

In such a case, however, there is another problem that the running cost increases due to noise and waste of energy caused by the cooling operation, and excess discharge of toner.

Therefore, a temperature sensor is conventionally provided in the developing unit to control the cooling operation in order to balance energy saving and noise reduction with cooling (Japanese Patent Application Laid-Open No. 2009-217067 (Patent Document 1)).

However, like in the developing unit disclosed in Patent Document 1, in a case where a temperature sensor is provided in a developing unit, the temperature of a developing unit can be measured but the temperature of a photosensitive body and temperature around the photosensitive body cannot be measured. Therefore, there is a need to add another temperature sensor.

Especially, like a tandem color image forming apparatus, in a system having a mode such as a K-monochrome (black monochrome) mode where there is an image forming section in which the developing unit is not driven but only the photosensitive body rotates, a difference in temperature between the developing unit and the photosensitive body becomes great. This makes it difficult for the temperature sensor in the developing unit to measure the temperature of the photosensitive body.

SUMMARY OF THE INVENTION

Therefore, it is an object of the present invention to provide an image forming apparatus comprising a plurality of image forming sections, which can deal with both (1) cooling of an image forming section which executes image formation and (2) cooling of an image forming section which does not execute image formation, without increasing the number of components.

In order to attain the above object, a typical structure of an image forming apparatus according to the present invention includes: a first image forming section; a second image forming section provided adjacent to the first image forming section on the downstream side of the first image forming section in an image conveying direction, each of the first and second image forming sections including a rotatable image bearing body on which a latent image is formed, a developing unit for developing the latent image with a developer, a temperature sensor provided on an external wall of the developing unit, and a cleaning unit that comes into contact with the image bearing body to clean off the image bearing body; a cooling unit for cooling the inside of an apparatus main body with airflow; and a controller capable of performing a developer discharging operation for discharging the developer from the developing unit to the image bearing body at the time of non-image formation, and capable of running a mode for controlling both an operation of the cooling unit and the developer discharging operation in each image forming section based on the detection results of each of the temperature sensors provided in the first image forming section and the second image forming section.

Further features of the present invention will become apparent from the following description of exemplary embodiments.

DESCRIPTION OF THE EMBODIMENTS

Preferred embodiments of the present invention will now be described in detail in accordance with the accompanying drawings. Note that the dimensions, materials, shapes, and relative arrangement of components to be described in the following embodiments should be changed arbitrarily according to the structure of and various conditions for an apparatus to which the present invention is applied and the scope of the present invention is not intended to be limited only to those to be described.

Embodiment 1

(1) Schematic Structure of Image Forming Apparatus

Figure 1:
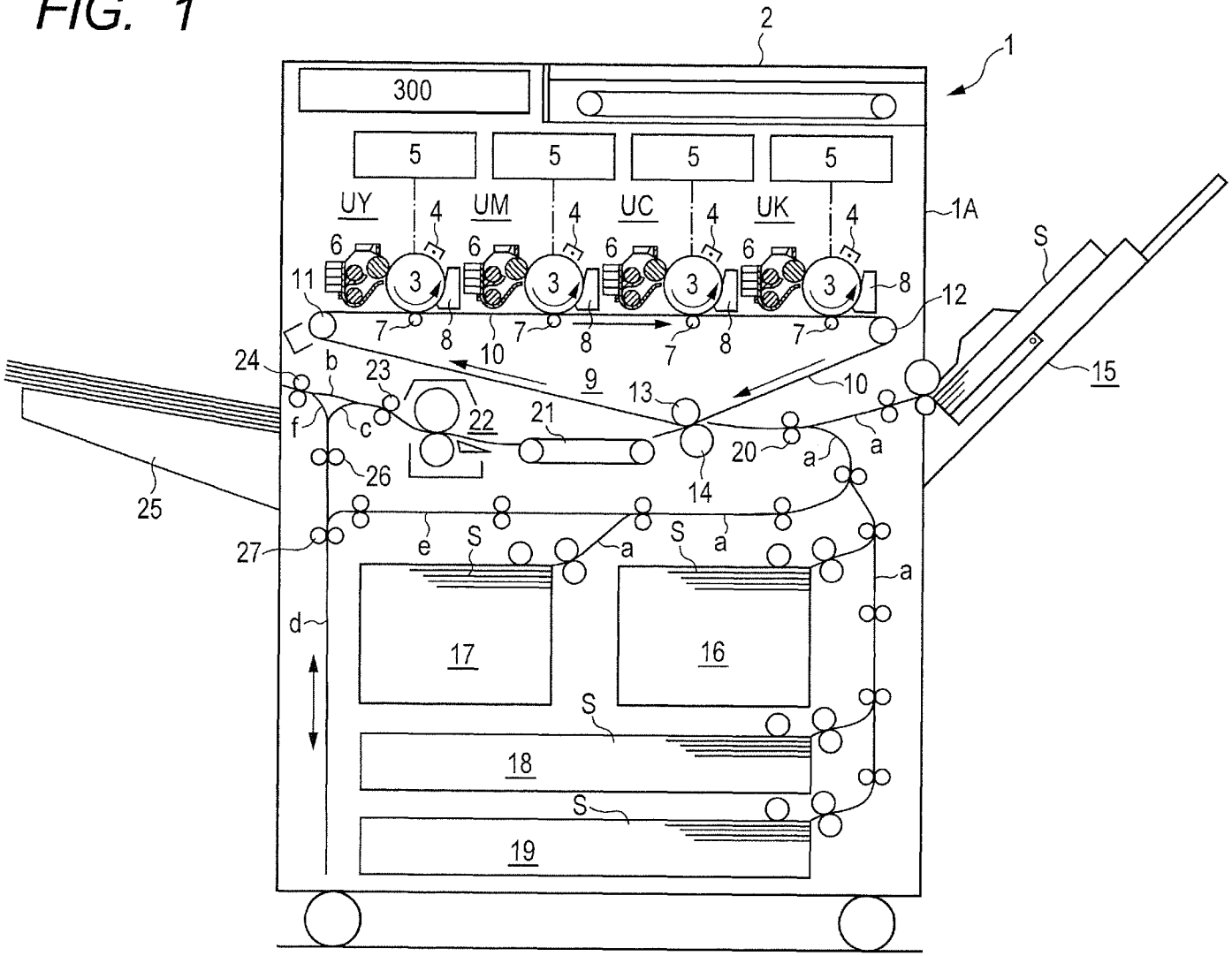
FIG. 1 is a schematic longitudinal sectional front view of an image forming apparatus 1 according to Embodiment 1.
Figure 2:
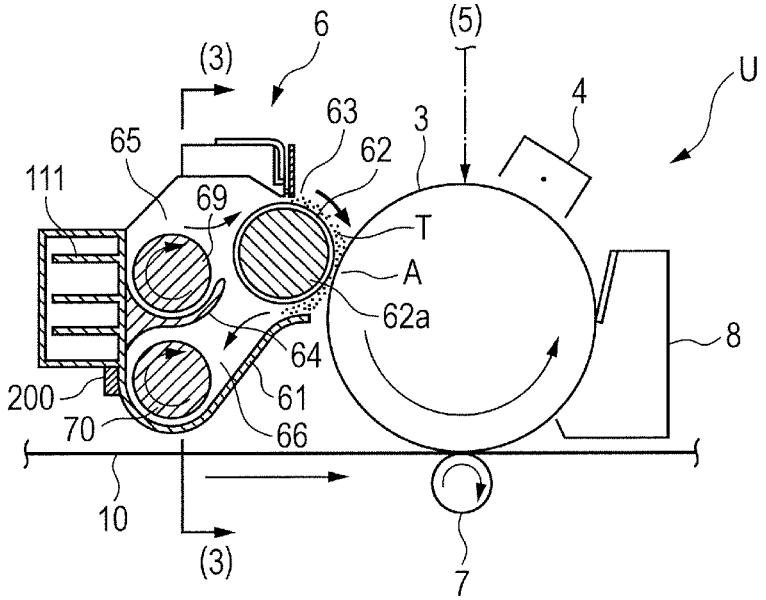
FIG. 2 is a partially enlarged schematic view of FIG. 1.

FIG. 1 is a schematic longitudinal sectional front view of an image forming apparatus 1 according to the embodiment, and FIG. 2 is a partially enlarged schematic view of FIG. 1. Here, in the image forming apparatus 1 of the embodiment, the front face (front side) is a side opposite to the user. The rear face side (rear side) is the opposite side of the front side. The forward direction is a direction from the rear side to the front side, and the rearward direction is a direction from the front side to the rear side. The right and left are right and left as viewed from the front side of the image forming apparatus. The left direction is a direction from the right side to the left side, and the right direction is a direction from the left side to the right side. The top and bottom is top and bottom in the direction of gravity. The upward direction is a direction from the bottom to the top, and the downward direction is a direction from the top to the bottom.

This image forming apparatus 1 is an intermediate transfer tandem type four four-color full-color electrographic copying machine. The intermediate transfer tandem type image forming apparatus excels in applicability to and printability on a wide variety of recording materials (sheet materials). A full-color image or a monochrome image corresponding to image information photoelectrically read by a document reading section (image scanner) 2 can be formed on a recording material (hereinafter referred to as "sheet") S and output as image formation.

Inside an image forming apparatus main body 1A, four first-to-fourth image forming sections (image forming stations) U (UY, UM, UC, and UK) are arranged side by side in a near-horizontal direction from left to right in FIG. 1. Respective image forming sections U are the same electrographic image forming mechanisms except that the colors of toner in the developer contained in respective developing units are different as yellow (Y), magenta (M), cyan (C), and black (K). FIG. 2 is a schematic enlarged view of one of the four image forming sections U in FIG. 1.

Each image forming section U has a drum type electrographic photosensitive body (hereinafter referred to as "drum") 3 as a rotatable image bearing body, respectively. The image forming section U also has a primary charging unit 4, an exposure unit (laser scanner) 5, a developing unit 6, a primary transfer unit 7, and a photosensitive body cleaner 8 as process units acting on the drum 3 along the rotational direction of the drum 3.

In each image forming section U, the drum 3 is provided nearly horizontally inside the image forming apparatus main body 1A, where one end side of the axial direction (rotational axis direction) is the front side and the other end side is the rear side. The primary charging unit 4, the developing unit 6, the primary transfer unit 7, and the photosensitive body cleaner 8 are provided substantially in parallel with the drum 3, where a direction along the axial direction (front-rear direction) of the drum 3 is the longitudinal direction.

The drum 3 in each image forming section U is driven to rotate at a predetermined speed in a counterclockwise direction indicated by the arrow, respectively. Then, a Y-color toner image corresponding to a Y-color component image of a full-color image to be formed is formed on the drum 3 in the first image forming section UY. An M-color toner image corresponding to an M-color component image is formed on the drum 3 in the second image forming section UM. A C-color toner image corresponding to a C-color component image is formed on the drum 3 in the third image forming section UC. A K-color toner image corresponding to a K-color component image is formed on the drum 3 in the fourth image forming section UK. Since the process and principle of electrophotographic image formation of a toner image on the drum 3 in each image forming section U is known, the description thereof will be omitted.

An intermediate transfer belt unit 9 is provided on the lower side of each image forming section U. This unit 9 has an endless intermediate transfer belt 10 having flexibility as an intermediate transfer body. The belt 10 is wound around three rollers, namely a drive roller 11, a tension roller 12, and a secondary transfer inside roller 13 in a tensioned state. The drive roller 11 is driven to move the belt 10 cyclically in a clockwise direction indicated by the arrow at a speed corresponding to the rotational speed of the drum 3.

A secondary transfer outside roller 14 is in contact with the secondary transfer inside roller 13 through the belt 10 by the application of a predetermined compressive force. The contact portion between the belt 10 and the secondary transfer outside roller 14 is a secondary transfer section. The primary transfer unit 7 in each image forming section U is provided on the inner side of the belt 10, and is in contact with the lower surface of the drum 3 through the belt 10, respectively. In each image forming section U, the contact portion between the drum 3 and the belt 10 is a primary transfer section. A predetermined primary transfer bias is applied to the primary transfer unit 7 at predetermined control timing.

Y-color toner, M-color toner, C-color toner, and K-color toner formed on the drums 3 in the respective image forming sections U are superimposed sequentially on and primarily transferred to the surface of the belt 10 cyclically moving. Thus, an unfixed full-color toner image with superimposed four colors, namely Y color, M color, C color, and K color, is synthesized and formed on the belt 10, and conveyed to the secondary transfer section.

On the other hand, a sheet S is fed from a sheet stock section and introduced into the secondary transfer section at predetermined control timing. The image forming apparatus of the embodiment has five first-to-fifth sheet stock sections 15 to 19, and one sheet S is separated and fed from a selectively designated sheet stock section. Then, the sheet S is conveyed along a conveying path a to a registration roller 20.

The registration roller 20 has the function of once receiving the leading edge of the sheet S, being conveyed, in a nip portion in a stop state to form a loop in order to correct skew feeding of the leading edge of the sheet S. The registration roller 20 also has the function of conveying the sheet S to the secondary transfer section at predetermined timing of image formation on the sheet S, i.e., in sync with the toner image borne on the belt 10. In other words, after correcting the skew feeding, the registration roller 20 feeds the sheet S to the secondary transfer section at predetermined control timing.

The sheet S is pinched and conveyed in the secondary transfer section. A predetermined secondary transfer bias is applied to the secondary transfer outside roller 14 at predetermined control timing. Thus, the full-color toner image on the belt 10 side is secondarily transferred to the sheet S sequentially and collectively.

Then, the sheet S that has exited from the secondary transfer section is separated from the surface of the belt 10, and introduced into a fixing unit 22 by means of a pre-fixing conveyance belt 21. The sheet S is pinched and conveyed by a fixing roller pair of the fixing unit 22 while being subjected to the application of heat and pressure. Thus, the unfixed toner image is fixed on the sheet surface as a fixed image. The sheet S that has exited from the fixing unit 22 is discharged onto a delivery tray 25 via internal delivery rollers 23, a conveying path b, and delivery rollers 24 (in the case of a one-side image forming mode).

In each image forming section U, toner remaining on the surface of the drum 3 after the primary transfer of the toner image onto the belt 10 is removed by the photosensitive body cleaner 8 from the drum surface to make the drum 3 provided for image formation in a repetitive fashion. Further, toner remaining on the surface of the belt 10 after the secondary transfer of the toner image onto the sheet S is removed by a belt cleaner 26 from the belt surface to make the belt 10 provided for image formation in a repetitive fashion.

In the case of a both-side image forming mode, the sheet S with an image formed on the front face (first face) that has exited from the internal delivery rollers 23 is drawn from a reverse guide path c into a switchback path d via upper reverse rollers 26 and lower reverse rollers 27. Then, forward reverse control (switchback operation) is performed on the rotational direction of the lower reverse rollers 27 to reverse the leading and trailing edges of the sheet S, and the sheet S is conveyed to a both-side conveying path e. After that, the sheet S is conveyed to the secondary transfer section via the conveying path a and the registration roller 20. Since an image forming process of the reverse face (second face) is the same as that of the front face (first face) mentioned above, the description thereof will be omitted.

Further, when the sheet S is to be reversely discharged, the rotation of the upper reverse roller 26 and the lower reverse roller 27 is reversed after the sheet S is drawn from the reverse guide path c into the switchback path d to allow the sheet S to exit in a direction opposite to the fed-in direction, where the trailing edge being fed in is reversed to the leading edge. Then, the sheet S is discharged onto the delivery tray 25 via a reverse delivery path f and delivery rollers 24.

Note that the number of colors of the image forming apparatus is not limited to four colors like in the apparatus 1 of the embodiment, and the alignment sequence of colors is not limited to that in the embodiment.

(2) Developing Unit 6

Figure 3:
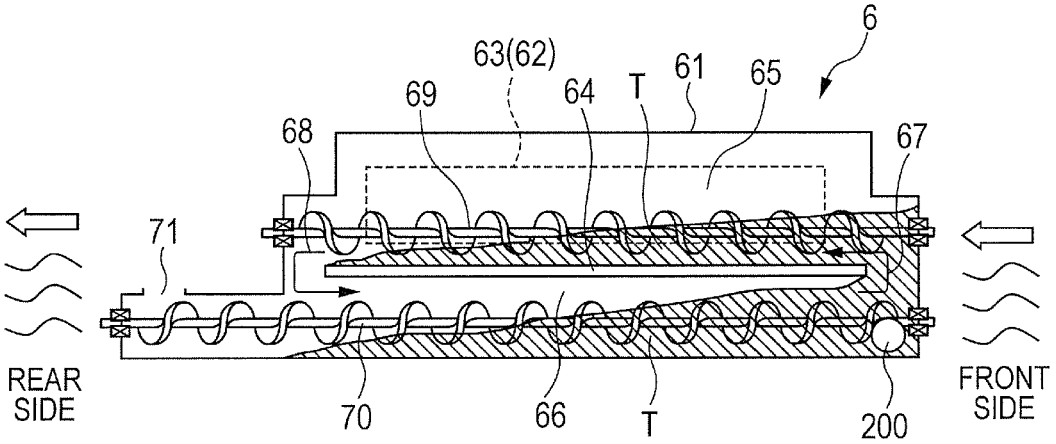
FIG. 3 is a schematic sectional view taken along the arrowed line (3)-(3) of FIG. 2.

Next, the developing unit 6 employed in the embodiment will be described with reference to FIG. 2 and FIG. 3. FIG. 3 is a schematic sectional view taken along the arrowed line (3)-(3) of FIG. 2. This developing unit 6 is a unit for developing a latent image into a toner image by applying a two-component developer T including non-magnetic toner and a magnetic carrier to the drum 3 with the latent image formed thereon. The developing unit 6 is horizontally long and the longitudinal direction thereof is a direction parallel to the rotation axis direction of the drum 3.

The developing unit 6 has a horizontally long developing container 61 in which the developer T is stored, and a developer carrying body (developing member) 62 that carries the developer T to apply (supply) the developer T to the drum 3 facing the developer carrying body 62. The developer carrying body 62 is rotatably arranged in an opening 63 provided in the developing container 61. The axis of rotation of the developer carrying body 62 is approximately parallel to the axis of rotation of the drum 3.

In the embodiment, a developing sleeve containing a magnet roller (magnetic field generation unit) 62*a* is used as the developer carrying body 62. The developing sleeve 62 carries the developer T by a magnetic force of the magnet roller 62*a* contained, rotates to convey the developer T in a developer conveying direction, and supplies the developer to an electrostatic latent image formed on the surface of the drum 3 in a development area A facing the drum 3.

The inside of the developing container 61 is compartmented into an upper developing chamber 65 and a lower stirring chamber 66 juxtaposed up and down horizontally through a dividing wall 64. A first opening 67 that makes the developing chamber 65 and the stirring chamber 66 communicate with each other is provided at one end in the longitudinal direction of the developing chamber 65 and the stirring chamber 66. A second opening 68 that makes the developing chamber 65 and the stirring chamber 66 communicate with each other is provided at the other end in the longitudinal direction of the developing chamber 65 and the stirring chamber 66. A developing screw 69 and a stirring screw 70 are arranged in the developing chamber 65 and the stirring chamber 66, respectively.

The developing screw 69 and the stirring screw 70 convey the developer T in the developing chamber 65 and the stirring chamber 66 while circulating the developer T among the first opening 67, the developing chamber 65, the second opening 68, and the stirring chamber 66. In other words, the developing container 61 has a structure for stirring and conveying the developer T while circulating the developer T in the developing container 61. Further, a toner replenishing port 71 for replenishing supplemental toner to the stirring chamber 66 is provided at the other end of the stirring chamber 66.

The developing screw 69 is a supply member for conveying the developer T in the developing chamber 67 to supply the developer T to the developing sleeve 62. The stirring screw 70 is a stirring member provided below the developing screw 69 in the vertical direction across the dividing wall 64 to stir the developer T in the stirring chamber 66.

The stirring screw 70 conveys supplemental toner, supplied from the toner replenishing port 71 into the stirring chamber 66 on the upstream side of the stirring screw 70 in the developer conveying direction, and a developer collected from the developing sleeve 62 via the development area A while stirring the toner and the developer to ensure the density uniformity of toner in the developer. The developer is pumped from the first opening into the developing chamber 65, conveyed by the developing screw 69, and supplied to the developing sleeve 62. FIG. 3 illustrates a developer circulation process inside the developing container 61 in the longitudinal direction of the developing container.

In the developer circulation process with longitudinal stirring, a distribution of developer amounts inside the developing container 61 in the longitudinal direction of the developing container as follows: As illustrated in FIG. 3, the amount of developer is largest in the first opening 67 and the amount of developer decreases as the developer comes close to the second opening 68. Such a distribution of developer amounts is caused basically by the following two factors:

The first factor is that, since the developer is pumped from the stirring chamber 66 into the developing chamber 65 through the first opening 67, the pressure of developer increases under the influence of gravity to increase the amount of developer. The second factor is that, the developer is supplied to the developing sleeve 62 in the developing chamber 65, so that the amount of developer decreases as the developer comes close to the second opening 68, while in the stirring chamber 66, the developer is received from the developing sleeve 62 in an opposite manner, so that the amount of developer increases as the developer comes close to the first opening 67.

Therefore, if there is a structure to which either of the first and second factors contributes, the amount of developer in the distribution of developer amounts as illustrated in FIG. 3 becomes large on the side of the first opening 67. Even if the stirring chamber 66 is not arranged below the developing chamber 65, since the second factor is satisfied, the advantageous effects of the embodiment to be described later will be obtained.

(3) Cooling Structure

Figure 4:
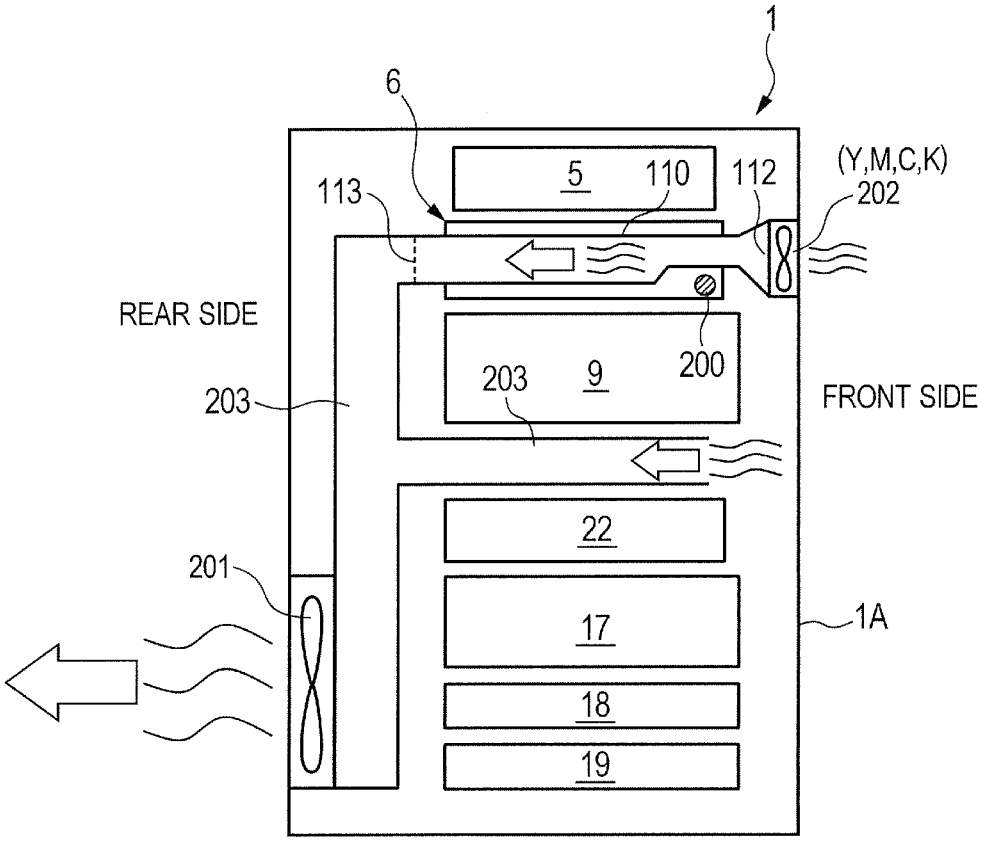
FIG. 4 is a schematic cross-sectional view of the left side of the image forming apparatus in FIG. 1.

The structure of a cooling unit for cooling built-in devices with airflow in the image forming apparatus 1 of the embodiment will be described with reference to FIG. 4.

First, a general cooling structure in the image forming apparatus (general cooling structure of built-in devices) is as follow: A built-in cooling fan 201 as a first cooling unit is provided in a lower part on the rear side of the image forming apparatus main body 1A. The built-in cooling fan 201 discharges internal air from the apparatus main body 1A through an exhaust air duct 203. The built-in cooling fan 201 also serves as an air curtain for preventing heat from the fixing unit 22 from climbing up to the neighborhood of the developing unit 6 while discharging heat from the neighborhood of the developing unit 6. Thus, the built-in cooling fan 201 totally cools, with airflow, the inside of the image forming apparatus, i.e., the built-in devices.

Next, a cooling structure for the developing unit 6 in each image forming section U is as follow: On the rear side (the side opposite to the side of the developing sleeve 62) of the developing container 61 of the developing unit 6 in each image forming section U, a heat sink (cooling fin) 111 made of A6063 material having good thermal conductivity is arranged on the dividing wall 64 of the developing container 61 and part of developing container on the rear side along the longitudinal direction. Further, a fan duct (cooling duct) 110 as an air duct for giving passage to cooling air to cool toner is provided to cover the entire area of the heat sink 111 in the longitudinal direction.

In other words, in the cooling structure installed in the developing unit 6, the air duct 110 is formed on the outer side of the developing container 61 and on the side opposite to the side of the developing sleeve 62, and the heat sink 111 is arranged on the dividing wall of the developing container 61 and part of the developing container on the rear side.

The heat sink 111 has ribs inside the fan duct 110 in a manner to increase the surface area exposed to the cooling air in order to enhance cooling efficiency. The ribs of the heat sink 111 in the embodiment are arranged to have the following dimensions: 1 mm thick, 5 mm pitch, and 10 mm high. Thus, the heat sink 111 is designed not to make the impedance of cooling air so high while increasing the surface area. Thus, the cooling fin made of a material having good thermal conductivity is provided in the fan duct so that the cooling efficiency of the developing unit can be enhanced.

The fan duct 110 is so designed that a cooling air inlet 112 is provided at a front end on the side corresponding to the first opening 67 as the front side opening in the developing unit 6, and a cooling air outlet 113 is provided at a rear end on the side corresponding to the second opening 68 as the rear side opening in the developing unit 6.

The air inlet 112 of the fan duct 110 leads to a development cooling fan 202 as a second cooling unit to draw air outside of the apparatus from the fan 202 into the fan duct 110. The air outlet 113 leads to the built-in cooling fan 201 through an exhaust air duct 203 to discharge air in the fan duct 110 from the fan 201. In the fan duct, air is drawn from the development cooling fan 202 to form an airflow for cooling the heat sink 111 from the front side toward the rear side of the developing unit 6. Thus, the developing unit 6, i.e., the developer (toner) T in the developing container 61 is cooled by the heat sink 111 cooled with airflow.

In the embodiment, one built-in cooling fan 201 is common to the four first-to-fourth image forming sections U (UY, UM, UC, and UK), but multiple built-in cooling fans can be provided if needed. One development cooling fan 202 is provided for each of the four first-to-fourth developing units, respectively.

(4) Temperature Control

In each image forming section U, targets to be cooled around the developing unit 6 and the drum 3 are basically divided into two types. One is the developer T in the developing container 61, and the other is the photosensitive body cleaner 8. A major cause of a rise in the temperature of the developer T in the developing container 61 is self-rising temperature caused by circulation of the developer, and a major cause of a rise in the temperature of the photosensitive body cleaner 8 is heat caused by friction between the drum 3 and the photosensitive body cleaner 8.

Therefore, in the embodiment, in the developing unit 6 of each image forming section U, a temperature sensor (temperature detection unit) 200 is arranged on the outer side of the developing container 61 in a position corresponding to a location where the developer T is filled inside the developing container 61. The temperature of the developer T inside the container can be measured by this temperature sensor 200 through the container wall of the developing container 61. The temperature sensor 200 is mounted on the outer side of the fan duct 110 of the developing unit 6. The temperature sensor 200 is arranged on the outer side of the fan duct 110 so that the temperature can be measured without any influence of cooling.

As described in the development process at (2), in the longitudinal stirring structure of the developing unit, the part of the first opening 67 in the developing container 61 is more stable in terms of the amount of developer and the pressure of the developer. Therefore, the temperature sensor 200 is provided near the first opening 67 correspondingly so that the temperature of the developer can be measured more stably.

In other words, in the longitudinal stirring developing unit for pumping developer from the stirring screw 70 as a stirring member to the developing screw 69 as a supply member, since the pumping side 67 is filled with developer stably, the temperature of the developer can be found out more accurately.

Temperature around the drum such as the photosensitive body cleaner 8 can be measured by the temperature sensor 200 mounted in the developing unit 6 for each color.

Then, the above-mentioned temperature sensor 200 is used as a temperature detection unit for dual purposes of temperature detection to control airflow cooling through the cooling units 201 and 202 and temperature detection to control the discharge of developer from the developing unit 6 to the drum 3 for refreshment of the developer.

The temperature sensor 200 is arranged on the outer surface of the developing container 61 so that both the temperature in the developing unit and the temperature around the drum can be acquired by a single sensor. Since the temperature sensor 200 is arranged on the outer side of the developing container 61 and developer is filled internally between the sensor and the container, both the temperature around the developing unit and the drum and the temperature of toner in the developing unit can be measured by a single sensor.

The temperature sensor may be adapted as a detachable unit. In this case, at a position of the developing container 61 where the temperature sensor is mounted, an opening may be provided opposite to a temperature detecting section of the unit. In the case, by mounting the unit on the developing container, one side of the unit directly contacts with the developer in the developing container while another side of the unit directly contacts with the air.

Figure 5:
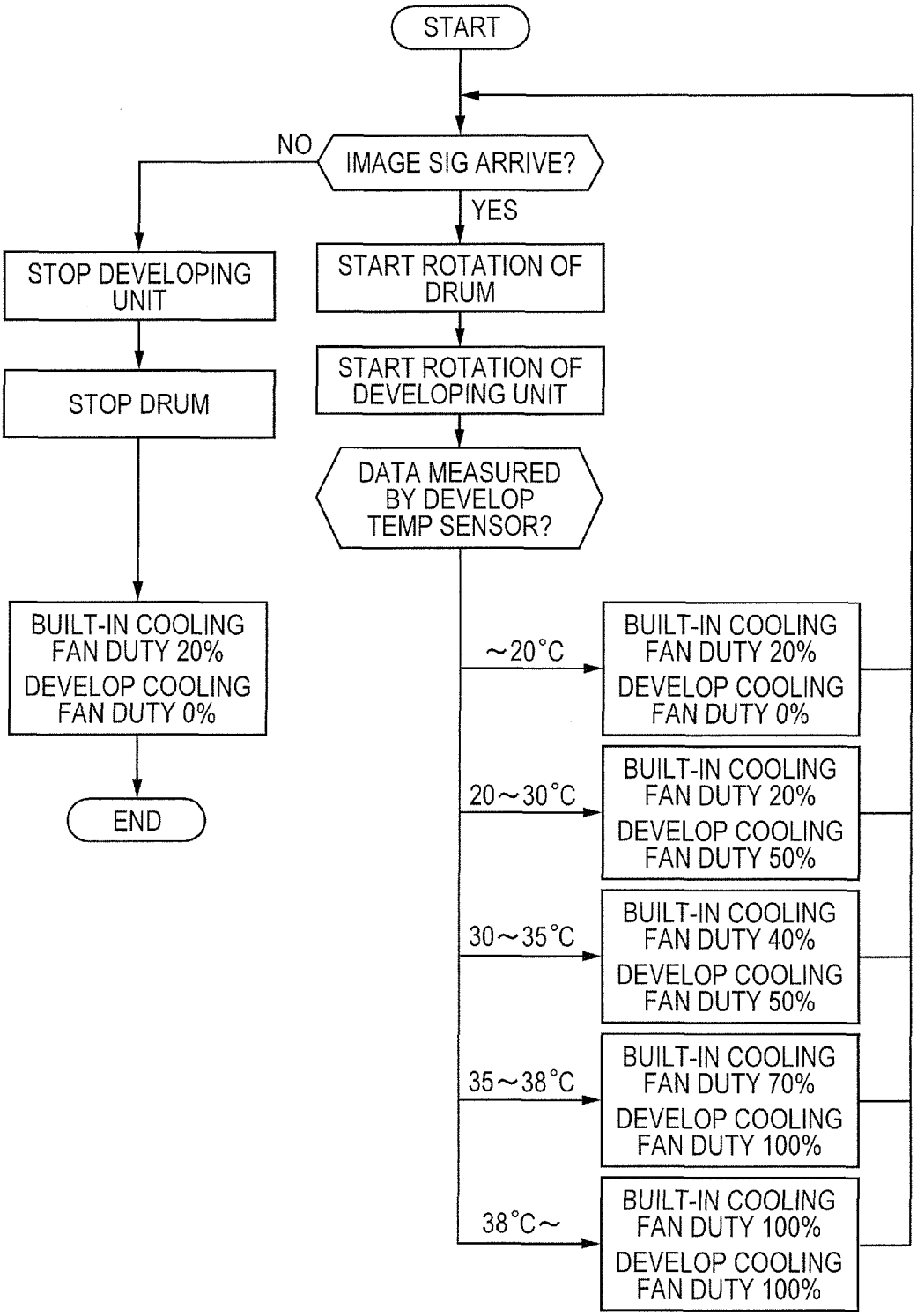
FIG. 5 is a flowchart of cooling fan control.

Based on temperature data obtained from the temperature sensor 200, a control unit (CPU: FIG. 1) 300 of the image forming apparatus changes the air capacities of the built-in cooling fan 201 and the development cooling fan 202 as cooling units for cooling the built-in devices with airflow as illustrated in a flowchart of FIG. 5.

In other words, based on temperature information detected by the temperature sensor 200, the control unit 300 makes the cooling capacity of the built-in cooling fan 201 as the first cooling unit variable, i.e., the cooling capacity of the cooling unit 201 can be adjusted according to the temperature around the developing unit and the drum. In the embodiment, the built-in cooling fan 201 performs control based on the output of a temperature sensor with the highest temperature among the temperature sensors 200 for respective colors.

Further, based on temperature information detected by the temperature sensor 200, the control unit 300 makes the cooling capacity of the development cooling fan 202 as the second cooling unit variable. In other words, the cooling capacity of the cooling unit 202 can be adjusted according to the temperature of the developer. In the embodiment, the development cooling fan for each color is controlled by the temperature sensor 200 for each color.

Figure 6:
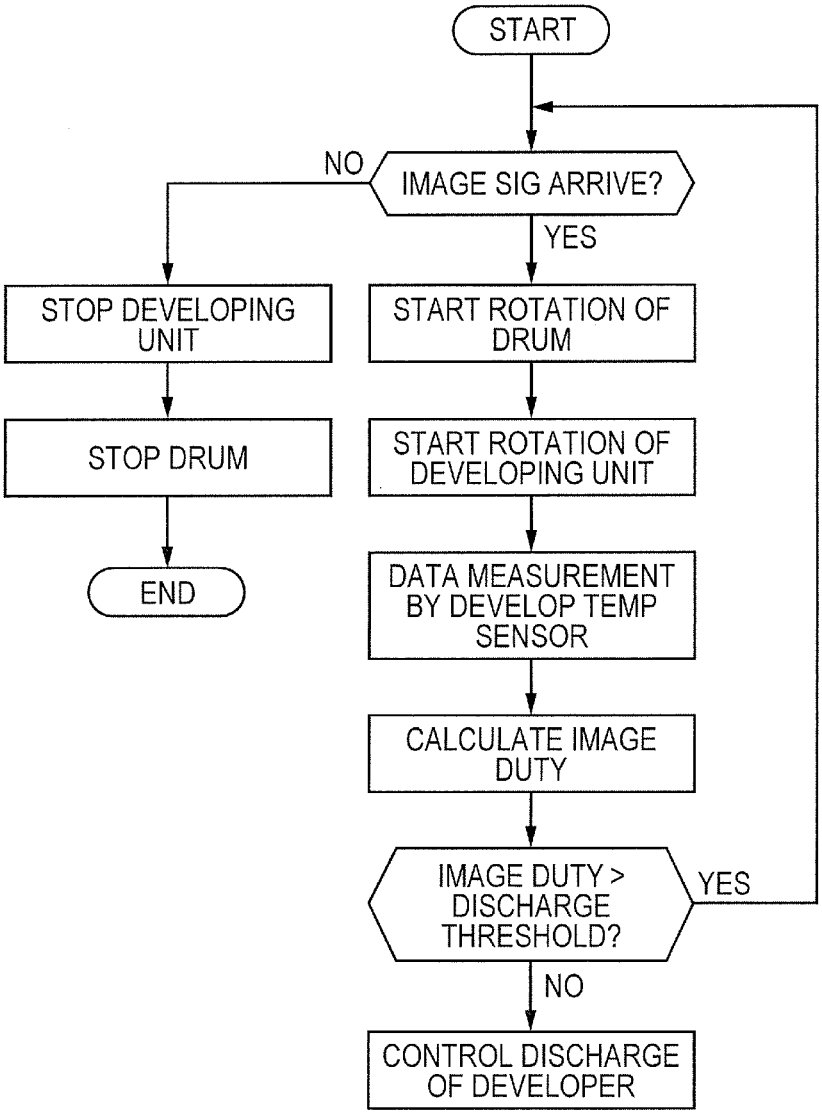
FIG. 6 is a flowchart of discharge control of developer.

Based on temperature data obtained from the temperature sensor 200, the control unit 300 also changes the amount of discharge of developer (the amount of discharge of developer to refresh the developer) from the developing unit 6 as illustrated in a flowchart of FIG. 6. The amount of discharge of toner can be adjusted according to the temperature of the developer in the developing unit. In other words, the control unit 300 makes the minimum consumption of developer in the developing unit 6 per predetermined time variable based on temperature information detected by the temperature sensor 200.

Since various methods of controlling the discharge of toner to be discharged from the developing unit 6 in order to refresh the developer are known (e.g., Japanese Patent No. 4280370), the description thereof will be omitted here.

The control unit 300 is a control unit for controlling the operation of the image forming apparatus 1 as a whole, which exchanges various electric information signals with the document reading section 2 or an image forming apparatus (not illustrated) and an external apparatus (not illustrated) such as a personal computer. Further, the control unit 300 processes electric information signals input from various process devices and sensors, processes command signals to various process devices, performs predetermined initial sequence control, and performs predetermined imaging sequence control.

As an example of temperature data in the structure of the embodiment, the built-in cooling fan 201 operates in the following settings: 20% duty ratio below 30° C., 40% duty ratio in a range between 30 and 35° C., 70% duty ratio in a range between 35 and 38° C., and 100% duty ratio above 38° C.

The development cooling fan 202 in each image forming section U individually operates in the following settings: 0% duty ratio below 20° C., 50% duty ratio in a range between 20 and 35° C., and 100% duty ratio above 35° C.

The amount of discharge of developer is set as follows: 1% below 40° C., 1.5% in a range between 40 and 42° C., 2% in a range between 42 and 44° C., and 2.5% above 44° C.

Embodiment 2

In the image forming apparatus 1 of Embodiment 1, since image formation is performed with simple color of K alone at the time of running in the K monochromatic mode (black-and-white mode), the drum 3 is rotated and the developing unit 6 is driven in the K-color fourth image forming section UK. However, in the first to third image forming sections UY, UM, and UC for Y color, M color, and C color, driving of the developing unit 6 is stopped, respectively, but the drum 3 is rotated because the drum 3 is in contact with the intermediate transfer belt 10.

In other words, the image forming apparatus having multiple image forming sections U has an image forming mode in which, when driving of the developing unit 6 in at least one of the multiple image forming sections is stopped, the developing unit 6 is driven and the drum 3 is rotated in the remaining image forming sections, respectively.

This leads to a rise in the temperature of the photosensitive body cleaner 8 in the image forming sections UY, UM, and UC that do not perform image formation. Therefore, the temperature of the photosensitive body cleaner 8 is monitored by the temperature sensor 200 of the developing unit 6 in an adjacent image forming section to switch among duty ratios of the development cooling fan 202 (Y, M, C) according to the temperature rise so as to cool the drum 3, respectively.

Thus, in the image forming apparatus having the image forming mode in which at least one of the developing units is not driven, temperature around the photosensitive body in each image forming section in which the developing unit is not driven can be measured by the temperature sensor of the developing unit in an adjacent image forming section to control the development cooling fan.

On the other hand, the image forming section in which the developing unit is driven (e.g., for K color) controls the K-color development cooling fan based on the temperature sensor mounted therein.

For example, the temperature of the drum 3 in the Y-color image forming section UY is measured by the temperature sensor 200 in the adjacent image forming section UM for M color to control the duty ratio of a development cooling fan 201Y as follows: 0% duty ratio below 30° C., 50% duty ratio in a range between 30 and 35° C., and 100% above 35° C. On the other hand, the development cooling fan in the K-color image forming section UK is controlled by the temperature sensor provided in the K-color developing unit. This leads to temperature control around the drum 3.

In the embodiment, the development cooling fan is controlled by the temperature sensor for each color in the full color mode, while in the black-and-white mode, the development cooling fan is controlled by the temperature sensor in an adjacent image forming section. Thus, the temperature sensors for controlling development cooling fans can be switched depending on the mode to ensure stable cooling.

Other Matters

1) The developing unit 6 of the embodiments uses a two-component developer, but the unit may use a one-component developer (magnetic or non-magnetic toner). The unit may be a contact-type developing system or a noncontact-type developing system.

2) The image forming apparatus 1 of the embodiments has the four first-to-fourth image forming sections in a tandem system, but the number of image forming sections can be two, three, five, or more. Further, an image forming apparatus having one image forming section as a monochromatic image forming apparatus can be constructed.

3) The image forming process of the image forming apparatus is not limited to the electrophotographic image forming process. The image forming process may be an electrostatic recording type of image forming process using an electrostatic recording type of dielectric body as the image bearing body, or a magnetic recording type of image forming process using a magnetic recording type of magnetic body as the image bearing body.

According to the present invention, both the temperature of developer in the developing unit and the temperature around the image bearing body are acquired by a single temperature detection unit to perform optimum airflow cooling control of built-in devices and optimum control of the discharge of developer based on detection temperature values acquired.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2012-101233, filed Apr. 26, 2012, which is hereby incorporated by reference herein in its entirety.

What is claimed is:

1. An image forming apparatus, comprising:

a plurality of image forming sections including a first image forming section and a second image forming section provided adjacent to the first image forming section on a downstream side of the image forming section in an image conveying direction, with the first image forming section including a first image bearing body, a first developing unit for developing a latent image formed on the first image bearing body, and a first cleaning unit that contacts with the first image bearing body to clean off the first image bearing body, and with the second image forming section including a second image bearing body and a second developing unit for developing a latent image formed on the second image bearing body;

a first temperature sensor provided on the first developing unit;

a second temperature sensor provided on the second developing unit at a position opposite to the first cleaning unit;

a first cooling unit configured to send airflow to the first developing unit to cool the first developing unit;

a second cooling unit configured to send airflow to the second developing unit to cool the second developing unit; and a control section configured to control the first cooling unit and the second cooling unit, wherein the control section is capable of performing each of (1) a first mode where image formation is executed using both the first image forming section and the second image forming section, and (2) a second mode where image formation is executed, in such a state that the first developing unit is suspended but the first image bearing body is driven, using an image forming section, and wherein in the first mode, the control section controls the first cooling unit based on an output of the first temperature sensor regardless of a temperature detected by the second temperature sensor, and in the second mode, the control section controls the first cooling unit based on an output of the second temperature sensor regardless of a temperature detected by the first temperature sensor.

2. The image forming apparatus according to claim 1, wherein the first developing unit comprises a first developer carrying body for developing a latent image formed on the first image bearing body, a supply chamber provided opposite to a periphery of the first developer carrying body to supply the developer to the first developer carrying body, a collection chamber provided opposite to the periphery of the first developer carrying body on an upstream side of the supply chamber in a rotation direction of the first developer carrying body to collect the developer from the first developer carrying body, a dividing wall for dividing the supply chamber and the collection chamber, a first connecting passage for delivering the developer from the supply chamber to the collection chamber on one end side of the dividing wall, and a second connecting passage for delivering the developer from the collection chamber to the supply chamber on the other end side of the dividing wall, and wherein the first temperature sensor is arranged on the other end side in a longitudinal direction of the first developing unit.

3. The image forming apparatus according to claim 2, wherein the collection chamber is provided below the supply chamber in a vertical direction, and the first temperature sensor is arranged on a side of pumping the developer from the collection chamber to the supply chamber in the longitudinal direction of the first developing unit.

4. The image forming apparatus according to claim 1, wherein the first cooling unit has a duct for allowing passage of air for cooling the first developing unit, and the duct is mounted on a lateral side of the first developing unit.

5. The image forming apparatus according to claim 4, wherein the first temperature sensor is mounted on an outer side of the duct.

6. The image forming apparatus according to claim 1, further comprising an intermediate transfer member, provided so as to able to contact with each of the first image bearing body and the second image bearing body, for transferring thereon the image formed by each image forming section, wherein in the first mode and the second mode, the first image bearing body and the second image bearing body contact with the intermediate transfer member.

7. The image forming apparatus according to claim 1, wherein in the first mode, the control section controls the second cooling unit based on an output of the second temperature sensor.

8. An image forming apparatus, comprising:

a plurality of image forming sections, each including an image bearing body for bearing an image; and a developing unit for developing a latent image formed on the image bearing body, wherein the developing unit includes a developer bearing body for bearing a developer; and a developing container for storing the developer, the developing container including a supply chamber for supplying the developer to the developer bearing body at a position opposite to a periphery of the developer bearing body;

a collection chamber for forming a circulation route through which the developer is circulated between the supply chamber and the collection chamber, the collection chamber collecting the developer from the periphery of the developer bearing body upstream of the opposite position with respect to a rotation direction of the developer bearing body;

a dividing wall for dividing the supply chamber and the collection chamber;

a first conveying member rotatably provided in the supply chamber to convey the developer, and a second conveying member rotatably provided in the collection chamber to convey the developer;

a temperature sensor provided at the developing unit of each of the image forming sections to detect a temperature;

a control unit capable of performing a mode to transfer the toner in the developing unit to the image bearing body between a preceding image and a proceeding image on the image bearing body during an image forming job, the control unit performing the mode for each of the image forming sections in accordance with a detection result by the temperature sensor provided at the developing unit; and a first cooling device for forming an airflow in a periphery of the image forming sections, wherein the control unit controls an operation of the first cooling device in accordance with the detection result by the temperature sensors, and wherein the temperature sensor provided at each of the developing units is provided outside of the developing container at a position corresponding to the circulation route and at an area downstream of a developer conveying direction in the collection chamber;

a duct provided at each of the developing units to form a passage of air for cooling the developing container; and a second cooling device provided at each of to the image forming sections to form an airflow in each of the ducts, wherein the control unit controls an operation of each of the second cooling devices in accordance with the detection result by the temperature sensor provided at the developing unit corresponding to each of the second cooling devices, and wherein each of the temperature sensors provided at the developing unit is provided outside of each of the ducts.

9. The image forming apparatus according to claim 8, wherein the collection chamber is provided below the supply chamber in a vertical direction in each of the image forming sections.

10. An image forming apparatus, comprising:

a plurality of image forming sections, each including an image bearing body for bearing an image; and a developing unit for developing a latent image formed on the image bearing body, wherein the developing unit includes a developer bearing body for bearing a developer; and a developing container for storing the developer, the developing container including a supply chamber for supplying the developer to the developer bearing body at a position opposite to a periphery of the developer bearing body;

a collection chamber for forming a circulation route through which the developer is circulated between the supply chamber and the collection chamber, the collection chamber collecting the developer from the periphery of the developer bearing body upstream of the opposite position with respect to a rotation direction of the developer bearing body;

a dividing wall for dividing the supply chamber and the collection chamber;

a first conveying member rotatably provided in the supply chamber to convey the developer; and a second conveying member rotatably provided in the collection chamber to convey the developer;

a temperature sensor provided at the developing unit of each of the image forming sections to detect a temperature;

a duct provided at each of the developing units to form a passage of air for cooling the developing container;

a first cooling device for forming an airflow in a periphery of the image forming sections;

a second cooling device provided at each of the image forming sections to form an airflow in each of the ducts; and a control unit for controlling the first cooling device and the second cooling devices, wherein the control unit controls an operation of each of the second cooling devices in accordance with the detection result by the temperature sensor provided at the developing unit corresponding to each of the second cooling devices, and controls an operation of the first cooling device in accordance with the detection result by the temperature sensors, and wherein the temperature sensor provided at each of the developing units is provided outside of the developing container at a position corresponding to the circulation route and at an area downstream of a developer conveying direction in the collection chamber.

11. An image forming apparatus, comprising:

a plurality of image forming sections, each including an image bearing body for bearing an image; and a developing unit for developing a latent image formed on the image bearing body, wherein the developing unit includes:

a developing container for storing the developer;

a temperature sensor to detect a temperature;

a duct provided in the developing unit to form a passage of air for cooling the developing container; and a first cooling device for forming an airflow in the plurality of the image forming sections, a second cooling device provided at each of the image forming sections to form an airflow in each of the ducts, a control unit configured to control an operation of the first cooling device and the second cooling devices;

wherein the control unit controls an operation of the first cooling device in accordance with the detection result by the temperature sensors, and wherein the control unit controls an operation of each of the second cooling devices in accordance with the detection result by the temperature sensor provided at the developing unit corresponding to each of the second cooling devices, and wherein each of the temperature sensors is provided outside each of the developing containers and is provided outside each of the ducts.

12. An image forming apparatus according to claim 11, wherein said developing container includes a supply chamber for supplying the developer to the developer bearing body;

a collection chamber for forming a circulation route through which the developer is circulated between the supply chamber and the collection chamber, the collection chamber collecting the developer from the periphery of the developer bearing body;

a dividing wall for dividing the supply chamber and the collection chamber;

a first conveying member rotatably provided in the supply chamber to convey the developer; and a second conveying member rotatably provided in the collection chamber to convey the developer;

wherein the temperature sensor provided at each of the developing units is provided at a position corresponding to the second conveying member at an area downstream of a developer conveying direction in the collection chamber.

13. An image forming apparatus according to claim 11, wherein the control unit is configured to execute a discharging operation for discharging a toner from the developing unit onto the image bearing body in a region corresponding to an interval between a recording material and a subsequent recording material in a continuous image forming job for continuously forming an image on a plurality of recording materials.

14. An image forming apparatus, comprising:

a plurality of image forming sections, each including an image bearing body for bearing an image; and a developing unit for developing a latent image formed on the image bearing body, wherein the developing unit includes:

a developing container for storing the developer;

a temperature sensor provided at the developing container to detect a temperature; and a duct provided in the developing unit to form a passage of air for cooling the developing container;

a first cooling device configured to form an airflow in the image forming apparatus;

a second cooling device provided at each of the image forming sections to form an airflow in each of the ducts; and a control unit configured to control an operation of the first cooling device in accordance with the detection result by the temperature sensors, and control an operation of each second cooling device in accordance with the detection result by the temperature sensor provided at the developing unit corresponding to each of the second cooling devices wherein each of the temperatures is detected outside of the ducts and at an exterior surface of a wall portion of the developing container corresponding to each of the temperature sensors, which is opposed to a containing portion of the developing container.

15. An image forming apparatus, comprising:

an image bearing body for bearing an image; and a developing unit for developing a latent image formed on the image bearing body, wherein the developing unit includes:

a developing container for storing the developer;

a temperature sensor provided at the developing container to detect a temperature; and a duct provided in the developing unit to form a passage of air for cooling the developing container;

a first cooling device configured to form an airflow in the image forming apparatus;

a second cooling device configured to form an airflow in the duct;

a temperature sensor to detect a temperature;

a control unit configured to control an operation of the first cooling device and the second cooling device based on the detection result of the temperature sensor;

wherein the temperature is detected outside of the duct and at an exterior surface of a wall portion of the developing container, which is opposed to a containing portion of the developing container.

* * * * *